US011685165B2

(12) United States Patent
Toda et al.

(10) Patent No.: US 11,685,165 B2
(45) Date of Patent: Jun. 27, 2023

(54) IMAGE RECORDING APPARATUS

(71) Applicant: CANON KABUSHIKI KAISHA, Tokyo (JP)

(72) Inventors: Kyosuke Toda, Kanagawa (JP); Yosuke Takagi, Kanagawa (JP); Akira Goto, Kanagawa (JP); Chiaki Muraoka, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 17/344,856

(22) Filed: Jun. 10, 2021

(65) Prior Publication Data

US 2021/0394523 A1 Dec. 23, 2021

(30) Foreign Application Priority Data

Jun. 17, 2020 (JP) ..... JP2020-104275

(51) Int. Cl.
*B41J 2/175* (2006.01)

(52) U.S. Cl.
CPC .. *B41J 2/17566* (2013.01); *B41J 2002/17579* (2013.01)

(58) Field of Classification Search
CPC ..... B41J 2/17566
See application file for complete search history.

(56) References Cited

U.S. PATENT DOCUMENTS 5,917,514 A 6/1999 Higuma et al. ..... 347/29
6,007,173 A 12/1999 Delouise et al. ..... 347/7
6,221,141 B1 * 4/2001 Takada ..... C09D 11/324 106/31.77
6,631,982 B2 10/2003 Sasaki et al. ..... 347/85
6,805,437 B2 10/2004 Yamanaka et al. ..... 347/92
6,851,795 B2 2/2005 Watanabe et al. ..... 347/50
(Continued)

FOREIGN PATENT DOCUMENTS

CN 1460842 12/2003
CN 105966074 9/2016
(Continued)

OTHER PUBLICATIONS

U.S. Appl. No. 17/341,308, filed Jun. 7, 2021.
(Continued)

*Primary Examiner* — Jason S Uhlenhake
(74) *Attorney, Agent, or Firm* — Venable LLP

(57) ABSTRACT

An image recording apparatus includes a liquid chamber that stores liquid, a first electrode pin and a second electrode pin to be inserted into the liquid chamber, applying unit for applying voltage across the first electrode pin and the second electrode pin, with the first electrode pin as an anode side and the second electrode pin as a cathode side, and detecting unit for detecting electric current flowing, and detection operation of detecting amount of liquid in the liquid chamber by the detecting unit detecting the electric current when the applying unit applies voltage. Prior to the detection operation, an oxidization aging operation is performed, in which the applying unit applies voltage across the first electrode pin and the second electrode pin. An amount of an oxide layer formed on at least a portion of the first electrode pin exposed inside the liquid chamber is greater than the second.

16 Claims, 10 Drawing Sheets

(56) References Cited

U.S. PATENT DOCUMENTS

| | | | | |
|---|---|---|---|---|
| 6,945,643 | B2 | 9/2005 | Tajima et al. | 347/87 |
| 7,044,588 | B2 | 5/2006 | Tajima et al. | 347/85 |
| 8,500,265 | B2 | 8/2013 | Yamakami et al. | 347/100 |
| 8,757,776 | B2 | 6/2014 | Yamakami et al. | 347/54 |
| 9,321,274 | B2 | 4/2016 | Takagi et al. | B41J 2/1752 |
| 9,493,009 | B2 | 11/2016 | Kimura et al. | B41J 2/1752 |
| 9,533,504 | B2 | 1/2017 | Takagi et al. | B41J 2/1433 |
| 9,597,884 | B2 | 3/2017 | Nanjo et al. | B41J 2/17526 |
| 9,821,562 | B2 | 11/2017 | Nanjo et al. | B41J 2/17523 |
| 9,840,082 | B2 | 12/2017 | Nanjo et al. | B41J 2/17513 |
| 10,207,511 | B2 | 2/2019 | Nanjo et al. | B41J 2/175 |
| 10,442,207 | B2 | 10/2019 | Kuwabara | G01F 23/242 |
| 2002/0118236 | A1 | 8/2002 | Uetsuki | 347/7 |
| 2003/0214545 | A1 | 11/2003 | Eguchi et al. | B41J 2/175 |
| 2005/0001863 | A1 | 1/2005 | Farr et al. | B41J 2/175 |
| 2013/0286065 | A1* | 10/2013 | Uetsuki | B41J 2/17566 347/7 |
| 2015/0343779 | A1 | 12/2015 | Takagi et al. | 347/50 |
| 2016/0263906 | A1 | 9/2016 | Kimura et al. | B41J 2/175 |
| 2017/0333932 | A1 | 11/2017 | Kuwabara | B05B 12/08 |
| 2020/0207103 | A1 | 7/2020 | Tamaru et al. | B41J 2/17509 |
| 2020/0290362 | A1 | 9/2020 | Tajima et al. | B41J 2/17509 |
| 2021/0162766 | A1 | 6/2021 | Omura et al. | B41J 2002/17579 |

FOREIGN PATENT DOCUMENTS

| | | | | |
|---|---|---|---|---|
| EP | 1350628 | | 10/2003 | |
| EP | 1493586 | | 1/2005 | |
| JP | H10-034971 | | 2/1998 | |
| JP | H1034971 A | * | 2/1998 | B41J 2/17566 |
| JP | 2015-223830 | | 12/2015 | |

OTHER PUBLICATIONS

Extended European Search Report dated Nov. 15, 2021 in counterpart EP Application No. 21179533.1.

Office Action dated Nov. 3, 2022 in counterpart Chinese Application No. 202110652472.5, together with English translation thereof.

* cited by examiner

IMAGE RECORDING APPARATUS

BACKGROUND OF THE INVENTION

Field of the Invention

The present invention relates to an image recording apparatus that ejects liquid such as ink or the like onto a recording medium and records images.

Description of the Related Art

Heretofore, there have been proposed various types of recording systems equipped with liquid ejection cartridge units, as means for ejecting liquid such as ink or the like onto a recording medium such as paper or the like to record images. For example, thermal transfer recording system, wire dot recording system, thermosensitive recording system, ink-jet recording system, and so forth, have come into practical use. Of these, ink-jet recording system has gained attention as a recording system with low running costs and suppressed recording noise, and is used in a broad range of fields. In ink-jet recording system, a recording element substrate that a liquid ejection cartridge unit is provided with is driven, thereby ejecting ink droplets from ink ejection orifices formed in a nozzle member on the surface of the recording element substrate. Ink jet recording system is an image recording system in which these ink droplets are made to land on desired positions on a sheet, thereby forming an image. In cases of many ink-jet recording methods, signals and electric power for driving the recording element substrate are supplied from an image recording apparatus, which is equipped with the liquid ejection cartridge unit, to the liquid ejection cartridge unit, through electrical connection portions.

As for forms, by which the liquid such as ink or the like used in image forming is supplied to the liquid ejection cartridge unit, there are various types of configurations. In one representative form, a liquid tank having a liquid accommodation chamber, provided separate from the liquid ejection cartridge unit, is directly connected to the liquid ejection cartridge unit, thereby supplying the liquid within the liquid tank to the liquid ejection cartridge unit. Also, a tube supply system, in which ink is supplied from a liquid tank set in the image recording apparatus to the liquid ejection cartridge via a liquid supply tube, is in practical use. In the case of the tube supply system, a commonly employed configuration is that a sub-tank is provided in the liquid ejection cartridge unit and that the liquid supplied from the liquid supply tube is temporarily held in the sub-tank, and then supplied to the recording element substrate.

In any of the above-described systems, liquid supplied from a liquid supply source is guided into the liquid ejection cartridge, and is guided to a supporting member on which the recording element substrate is mounted, through a liquid supply channel formed in the housing of the liquid ejection cartridge unit. Image recording apparatuses need a function of ascertaining the remaining amount of liquid at the supply source. There are two main objects to this. One object is, when there is little liquid remaining, to perform display to that effect, so that the user is prompted to replace the liquid tank, replenish liquid thereto, or the like. A second object is, in a case in which ejection operations are performed in a state where the liquid is depleted, to trigger printing control, such as split printing and so forth, in order to prevent damage of the nozzle member.

Various methods for detection of the remaining amount of liquid have been proposed heretofore. Examples of such proposals include a dot count system in which the remaining amount of liquid is calculated from the count of ejection firings of liquid, a prism system in which light is cast on the liquid accommodation chamber and the reflected light level is acquired by a sensor, thereby performing determination, a pin remaining-amount-detection system in which electrode pins are inserted into the liquid accommodation chamber and electric responses are obtained, and so forth. Of the above examples, the pin remaining-amount-detection system has been widely used, due to costs of introduction being relatively low, and detection precision being high.

In the pin remaining-amount-detection system, electric signals are applied to two electrode pins inserted in the liquid accommodation chamber, and detection of the remaining amount is performed. The majority of liquids such as ink, used in image recording as described above, are electroconductive. Accordingly, in a case in which there is liquid in the liquid accommodation chamber (in a state where the two electrode pins are in contact with liquid), and electric signals are applied to the electrode pins, electric current flows between the electrode pins via the liquid. Conversely, in a case in which there is no liquid (in a state where the two electrode pins are not in contact with liquid), the state is one in which there is no electric path between the electrode pins, and accordingly there is no flow of electric current. Further, with regard to the value of electric current, the amount of electric current flowing at the electrode pins increases in accordance with the area thereof in contact with the liquid, and thus the remaining amount of liquid can be detected in stages. In light of such characteristics, the configuration in which electric signals are applied across electrode pins and electric response is obtained, thereby determining whether or not there is liquid, has been employed (Japanese Patent Application Publication No. 2015-223830).

SUMMARY OF THE INVENTION

However, there is a possibility that the configuration described in Japanese Patent Application Publication No. 2015-223830 may have the following problem.

Metal stainless steel material or the like is the primary material used for the electrode pins. When one of the two electrode pins is used as an anode side and the other as a cathode side, and operations of applying electric current in one direction in a state of liquid being interposed between the electrode pins is repeatedly performed, oxidizing and reducing reactions of metal may occur at the surfaces of the electrode pins. That is to say, oxidization advances at the surface of the anode-side electrode pin, while reduction advances at the surface of the cathode-side electrode pin. As the above reactions advance, the electrical resistance increases due to the effects of the anode-side electrode pin being oxidized, and the value of the electric current flowing between the electrode pins decreases despite a certain amount of liquid being present. In a case of detecting the remaining amount of liquid in stages, and in a case of setting threshold values in stages in accordance with physical properties of the liquid, there is concern that an amount of liquid that is different from the remaining amount of liquid set in stages is erroneously detected.

When the detection precision of the remaining amount of liquid deteriorates, there may be situations in which the user is prompted to replace the liquid tank despite liquid still remaining, or discarded liquid increases in sequences of filling liquid.

In this way, deterioration in detection precision of the remaining amount of liquid is undesirable from the perspectives of usability and discarding.

An object of the present invention is to provide a technology whereby detection precision of the remaining amount of liquid can be improved.

In order to achieve the above object, an image recording apparatus according to the present invention includes:

a liquid chamber that stores liquid to be used in recording an image;

a first electrode pin and a second electrode pin to be inserted into the liquid chamber;

applying unit for applying voltage across the first electrode pin and the second electrode pin, with the first electrode pin serving as an anode side and the second electrode pin serving as a cathode side; and detecting unit for detecting electric current flowing across the first electrode pin and the second electrode pin, wherein the image recording apparatus is capable of performing a detection operation of detecting a remaining amount of liquid in the liquid chamber by the detecting unit detecting the electric current when the applying unit applies voltage across the first electrode pin and the second electrode pin, prior to executing the detection operation, an oxidization aging operation is performed, in which the applying unit applies voltage across the first electrode pin and the second electrode pin, and an amount of an oxide layer formed on at least a portion of the first electrode pin exposed inside the liquid chamber is greater than an amount of an oxide layer formed on a portion of the second electrode pin exposed inside the liquid chamber.

According to the present invention, detection precision of the remaining amount of liquid can be improved.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

First Embodiment

Figure 1A:
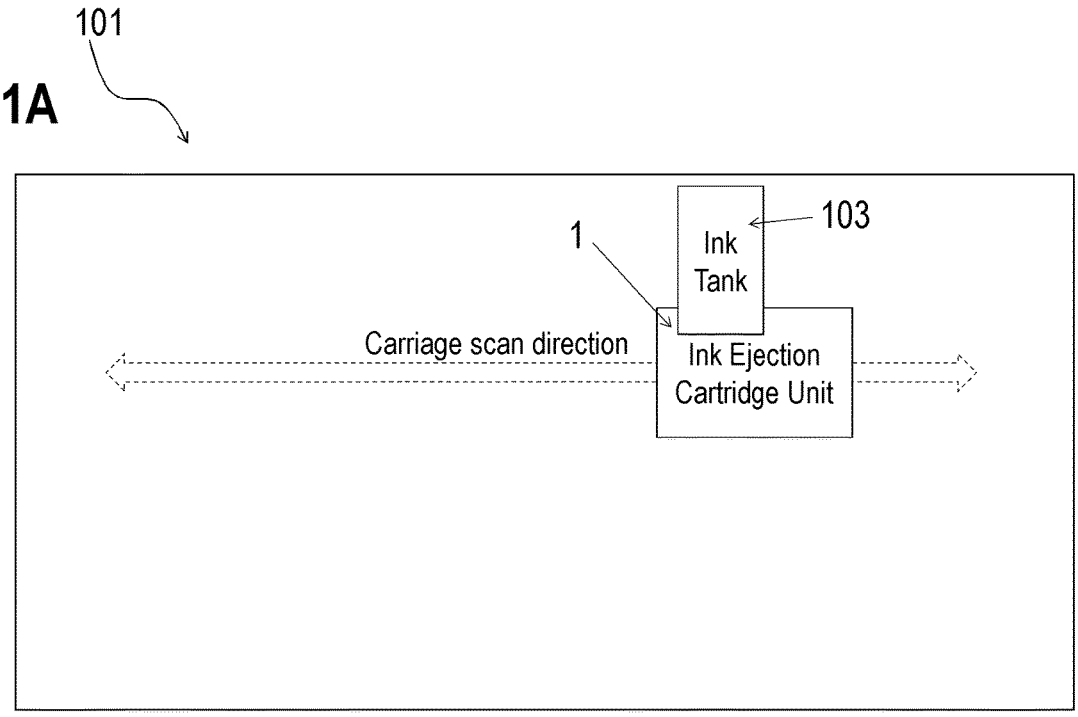
FIGS. 1A and 1B are schematic diagrams illustrating an apparatus configuration example of an image recording apparatus according to an embodiment of the present invention.
Figure 1B:
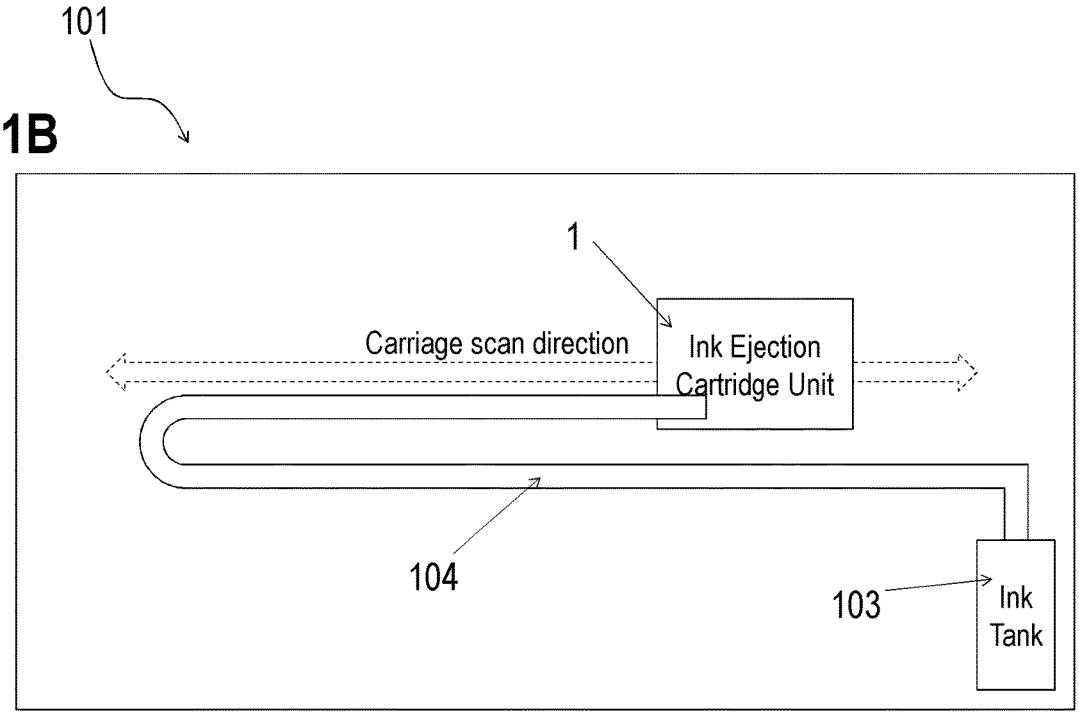

FIGS. 1A and 1B are simplified schematic diagrams of an image recording apparatus 101 and a liquid ejection cartridge unit (hereinafter referred to as "liquid ejection head) 1 according to an embodiment of the present invention. FIGS. 1A and 1B illustrate image recording apparatuses 101 of which the liquid supply methods to the liquid ejection head 1 are different. The present invention can be suitably applied to each configuration. FIG. 1A illustrates a configuration of a so-called on-carriage ink tank system. This is an arrangement in which an ink tank 103, serving as a liquid tank accommodating ink as a liquid to be used for image recording, is directly connected to the liquid ejection head 1 having ink ejecting functions, and supplies ink thereto. In comparison, FIG. 1B illustrates a configuration of a so-called tube supply system. This is an arrangement in which ink as a liquid is supplied from the ink tank 103 disposed within the image recording apparatus 101 to the liquid ejection head 1 via an ink supply tube 104 serving as a liquid supply tube.

A function for detecting a case of ink supply to the liquid ejection head 1 being depleted is necessary for both of the systems illustrated in FIGS. 1A and 1B. There are two main objects of detection of the remaining amount of ink, which are as follows. One is to perform a display to the user to the effect that the ink tank 103 is empty of ink, and prompt the user to replace the ink tank 103 or to refill the ink. A second is to detect that ejection operations will be performed in a state with no ink at the liquid ejection head 1 in advance, and trigger printing control such as stopping printing or performing split printing or the like, in order to prevent damage of the nozzle member and so forth, from ejecting on empty. Particularly, in a tube supply system configuration such as illustrated in FIG. 1B, there are cases where air passes through the ink supply tube 104 and enters the ink supply channel due to prolonged periods of unuse, even though ink remains in the ink tank 103. A configuration to detect the remaining amount of ink is provided in the liquid ejection head 1 in the present embodiment, to detect ejecting on empty occurring in such cases as well.

Figure 2B:
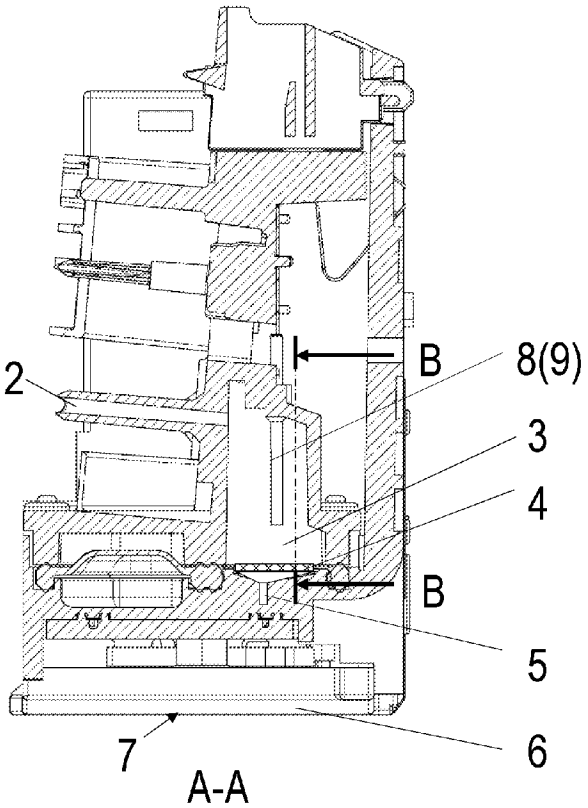
FIGS. 2A and 2B are explanatory diagrams of a configuration of a liquid ejection cartridge unit.
Figure 2A:
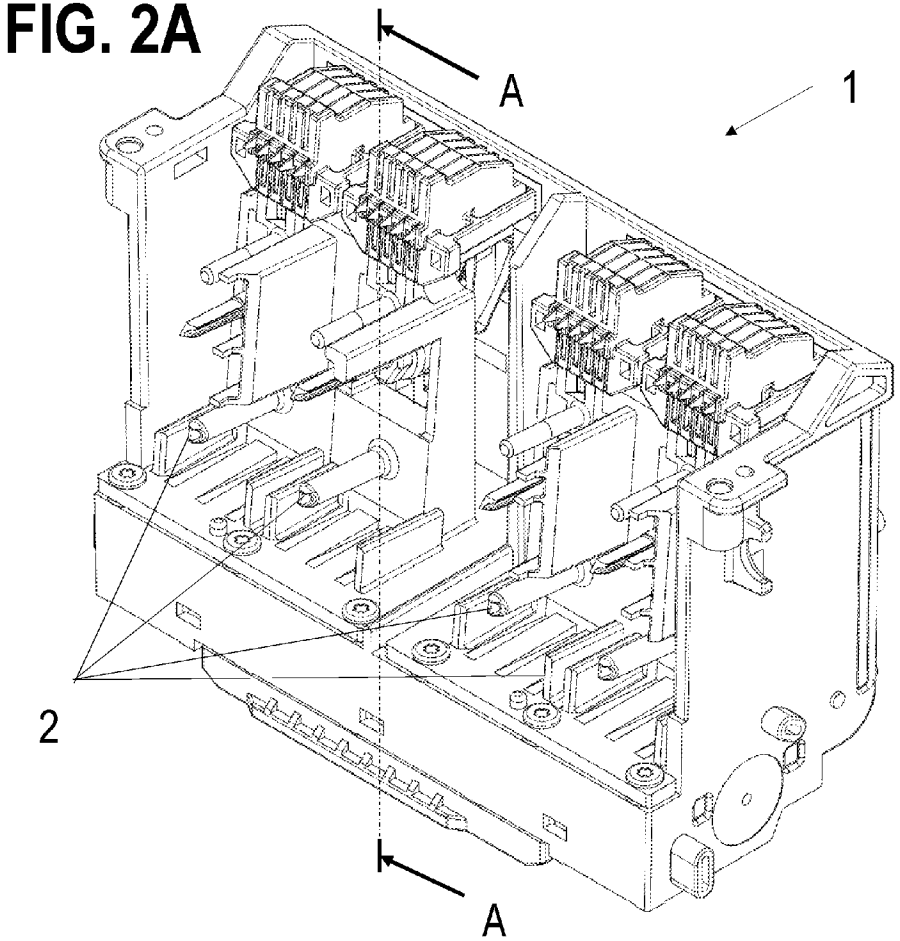

FIGS. 2A and 2B illustrate a detailed configuration of the liquid ejection head 1 that has remaining-ink-amount detection functions inside. FIG. 2A is a perspective view of the liquid ejection head 1, and FIG. 2B is a cross-sectional view of the liquid ejection head 1. The liquid ejection head 1 according to the present embodiment has recording element substrates 7 provided with functions for ejecting liquid such as ink 100 or the like, and is mounted on a carriage of the image recording apparatus and forms images by ejecting the liquid onto a recording medium while being scanned. Note however, that the liquid ejection head 1 is not limited to being scanned by a carriage, and may be a full-line liquid ejection head that is provided with as many recording element substrates as necessary for the entire printing width.

The ink 100 to be ejected for forming images is supplied from the ink tank 103 that pools the ink therein, into the liquid ejection head 1. The liquid ejection head 1 illustrated in FIGS. 2A and 2B have a channel for supplying the ink 100 to the recording element substrates 7 having functions of ejecting ink, via ink connection inlets 2, ink pooling chambers 3, filters 4, ink channels 5, and support members 6. The method of supplying ink to the ink connection inlets 2 may be to directly connect the ink tanks 103 and perform supplying thereby (FIG. 1A), or to supply from the ink tanks 103 disposed in the image recording apparatus 101 through the ink supply tubes 104 or the like (FIG. 1B).

In the present embodiment, a first electrode pin 8 and a second electrode pin 9 for detecting the remaining amount of ink are provided in each ink pooling chamber 3 that serves as a liquid chamber for temporarily holding and pooling ink, i.e., a liquid storage chamber. Although only one electrode pin is illustrated in FIG. 2B, this is because two electrode pins are arrayed in the direction perpendicular to the plane of the Figure, with one electrode pin hidden behind the other electrode pin (the second electrode pin 9 is hidden behind the first electrode pin 8). Although the electrode pins 8 and 9 are formed of SUS304 (JIS: Japanese Industrial Standards) stainless steel in the present embodiment from the perspective of corrosion resistance to ink, out of various types of stainless steel, SUS316 (JIS) stainless steel may be used for the same reason. In a case of ink properties in which corrosion/precipitation reaction is not a problem, materials that allow for easy header working, such as SUSXM7 (JIS) stainless steel, SUS304Cu (JIS) stainless steel, and so forth, may be used from the perspective of workability of the pins. Materials applicable to the electrodes are not limited to stainless steel, and any material may be used as long as the material exhibits oxidization and reduction. The electrode pins 8 and 9 inserted into the ink pooling chambers 3 have a contact point with an electric connecting member at the end on the opposite side from the end protruding into the ink pooling chambers 3, and are electrically connected to the image recording apparatus 101 via the electric connecting member.

Figure 3:
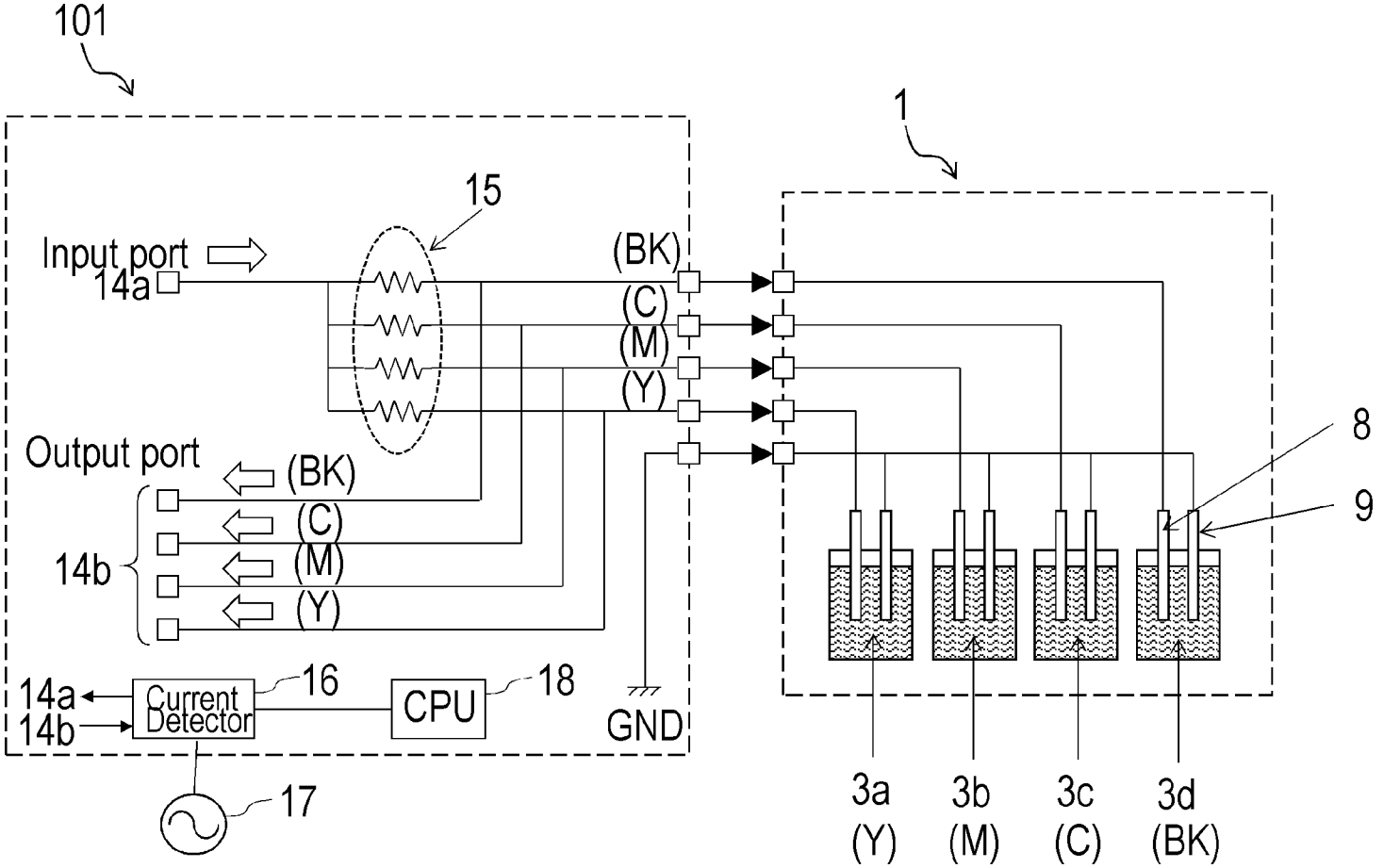
FIG. 3 is a circuit configuration diagram of a detection system for detecting remaining amount of ink according to the embodiment of the present invention.

FIG. 3 is a simplified illustration of the configuration of a system that detects the remaining amount of ink by the electrode pins 8 and 9. Signals for performing detection of the remaining amount are input from an input port 14*a* at the apparatus main unit side of the image recording apparatus 101. The input signals are branched into as many branches as the number of colors of ink regarding which the remaining amount is to be detected, and are applied to the anode-side first electrode pins 8 provided in the ink pooling chambers 3 of the liquid ejection head 1 via respective detecting resistors 15. Also, the cathode-side second electrode pins 9 provided within the ink pooling chambers 3 are short-circuited within the liquid ejection head 1, and connected to a ground terminal GND of the image recording apparatus 101. Also, output ports 14*b* for output of remaining amount detection are connected between the detecting resistors 15 and the anode-side first electrode pins 8, and the number of output ports 14*b* is the same as the number of colors of ink regarding which detection is to be performed.

In the above-described configuration, a current detector 16 of the image recording apparatus 101 detects the voltage dividing ratio of electrical resistance R of the detecting resistors 15 and the ink as output, and transmits this output to a control unit 18 that controls operations of the image recording apparatus 101. The control unit 18 controls an electric power source circuit of which commercial power 17, to which the image recording apparatus 101 is connected, is the electric power supply source serving as voltage applying unit, and can optionally control the magnitude and polarity of the voltage of electric signals applied across the electrode pins 8 and 9. The control unit 18 acquires the voltage across the electrode pins 8 and 9 by a current value detected by the current detector 16, serving as current detecting unit connected to this electric power source circuit, and can detect the remaining amount of ink within each of the ink pooling chambers 3 from the magnitude thereof. The above configuration makes up a liquid-remaining-amount detecting mechanism in the image recording apparatus 101 according to the present embodiment.

In a case in which there is no ink in the ink pooling chambers 3, the state across the anode and cathode electrode pins 8 and 9 is an electrically open state, and accordingly no current flows to the liquid ejection head 1 side. Accordingly, voltage close to that of the input signal is detected at the output ports 14*b*. Conversely, in a case in which there is ink in the ink pooling chambers 3, the anode and cathode electrode pins 8 and 9 are electrically connected through the ink, and accordingly current flows to the liquid ejection head 1 side. Accordingly, the signal detected at the output ports 14*b* is output of a low voltage level as compared to the input signal.

Details of the ink pooling chamber 3 will be described with reference to the schematic cross-sectional views of the ink pooling chamber 3 in FIGS. 4A and 2B.

Figure 4A:
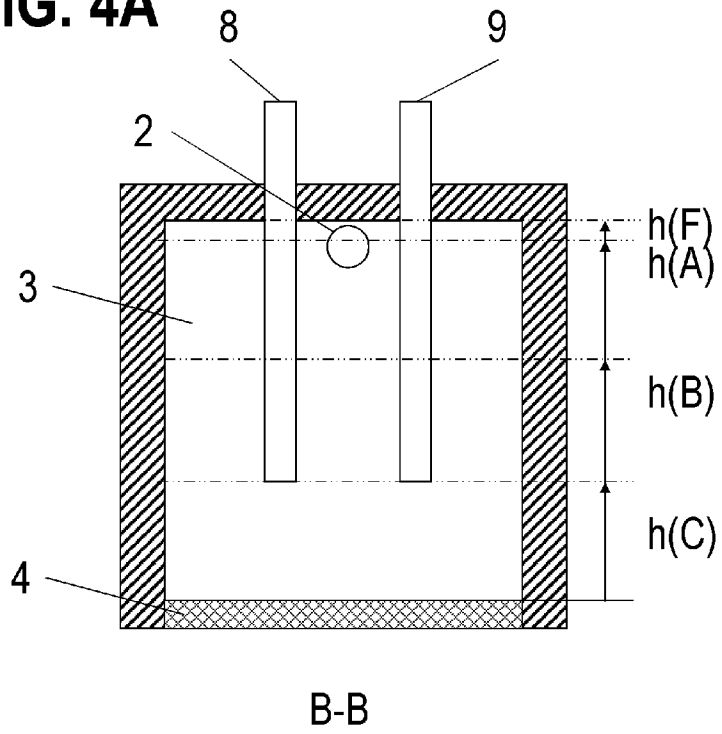
FIGS. 4A and 4B are diagrams illustrating an example of output signals after oxidization of a first electrode pin (anode side)

FIG. 4A is a cross-sectional view taken along B-B in FIG. 2B that schematically illustrates a detailed configuration of the ink pooling chamber 3. The first electrode pin 8 and the second electrode pin 9 are disposed penetrating into the inside of the ink pooling chamber 3, downward from the upper face of the ink pooling chamber 3, and detect an ink liquid level height h with which the ink pooling chamber 3 is filled. As for the method of detection, the first electrode pin 8 is used as a positive pole and the second electrode pin 9 is used as a negative pole, and the amount of voltage drop when potential is applied is detected. Accordingly, ink that can be detected is limited to ink types that pass electric current. In the present embodiment, black ink using self-dispersing type carbon black (CB), such as carboxylic type CB or the like, is employed out of self-dispersing type pigments, from the perspective of image performance and material costs.

Figure 4B:
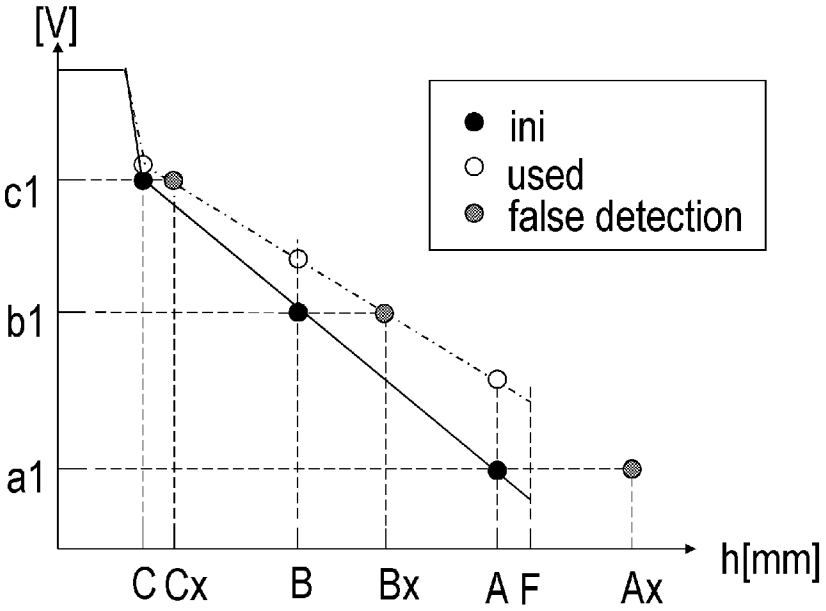

FIG. 4B is a graph showing voltage output across the electrode pins 8 and 9 as to the ink liquid level height h. In this graph, characteristics at an initial state, in which the number of times and duration of applying potential across the electrode pins 8 and 9 are few and short is indicated by "ini", and characteristics at a state in which potential has been applied across the electrode pins 8 and 9 for a great number of times and over prolonged periods, by using the liquid ejection head for a prolonged period of time, is indicated by "used". Great change in characteristics such as described above differ in change rate and rapidity of change, depending on the type of ink. Change in voltage output has been confirmed with black ink using carboxylic type CB. The above change in characteristics is not limited to self-dispersing type pigment inks, and similar change in characteristics may occur in resin-dispersed pigment inks and dye inks as well.

When the ink liquid level height h exceeds h=C, the electrode pins 8 and 9 come into contact with the ink, and electric current flows. A voltage drop occurs in accordance with the amount of current flowing, and voltage output drops. Assuming that the ink liquid level height h can be as high as a maximum F, the surface area of the ink in contact with the electrode pins 8 and 9 increases as the ink liquid level height h increases, and the amount of electric current increases, and accordingly the voltage output drops. By using this phenomenon, the amount of ink with which the ink pooling chamber 3 is filled can be detected by setting the voltage output as to the ink liquid level height h in advance. For example, by setting ink liquid level height h=C when voltage c1 and ink liquid level height h=B when voltage b1, the detecting voltage b1 can be used as a flag to prompt the user to prepare a replacement ink tank. Also, in the same way, the detecting voltage c1 can be used as a flag to prompt the user to replace the ink tank. As a separate usage, by setting ink liquid level height h=A when voltage a1, the detecting voltage a1 can be used as a flag to notify the user that filling the ink pooling chamber 3 with ink is complete.

Figure 5B:
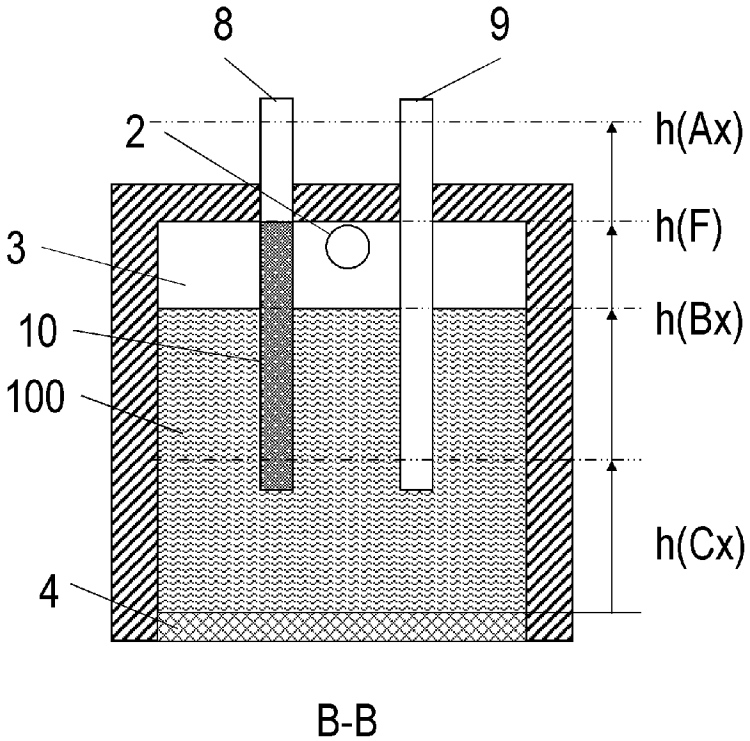
FIGS. 5A and 5B are schematic diagrams illustrating the relation among ink liquid level height, advance in oxidization of an electrode pin, and voltage output.
Figure 5A:
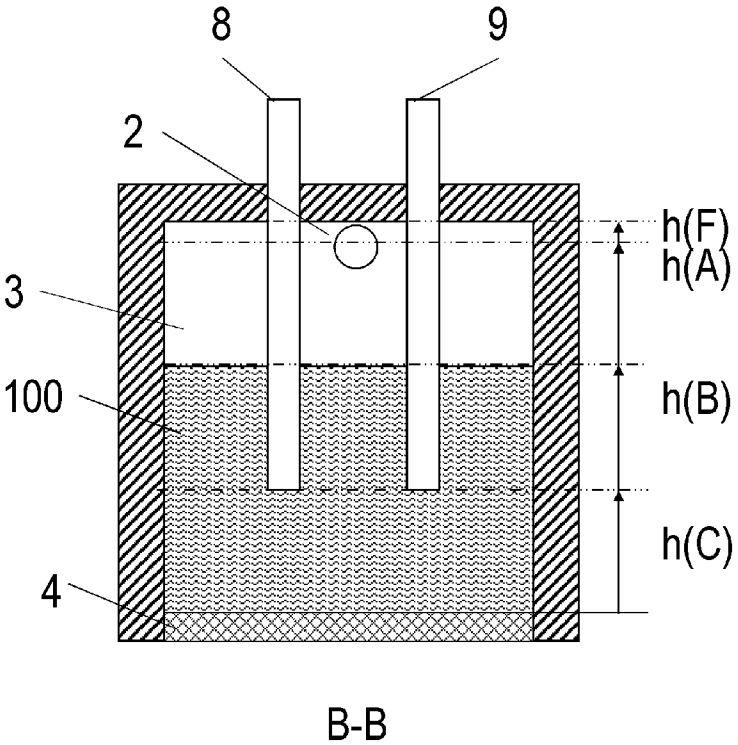

In a case in which the difference in the tilts between the "ini" graph and the "used" graph is great, as in FIG. 4B, detection of the same voltage b1 may indicate an ink liquid level heights h=B and h=Bx that are entirely different. FIGS. 5A and 5B illustrate this. FIG. 5A and FIG. 5B are cross-sectional views, taken along B-B, of the ink pooling chamber 3 in the initial state of use and, after being used for prolonged periods, respectively. When voltage output characteristics greatly change in this way, the user cannot be prompted to prepare or replace ink tanks at an appropriate timing, leading to lower usability. Also, a state in which the ink-filling-completed flag voltage a1 is not output, unless the ink 100 is in contact with electrodes over an area that exceeds the surface area of the electrode pins 8 and 9 that are inside the ink pooling chambers 3, as indicated by ink liquid level height h=Ax in FIG. 5B, may occur. That is to say, the deviation between the measured value and the actual state is so great that the state detection that is desired cannot be performed unless a state that is unrealistic is attained. In this case, ink filling cannot be completed. Although an example where the electrode pins 8 and 9 are disposed passing through the upper face of the ink pooling chamber 3 has been described in the present embodiment, the same phenomenon in which completion of ink fulling cannot be detected may occur in cases where the electrode pins 8 and 9 are disposed passing through a side face.

The reason why the voltage output characteristics change after prolonged use is that the first electrode pin 8 is set to the positive pole. Applying electric current promotes oxidization/reduction reaction, increasing the thickness of an oxide layer 10 on the surface of the stainless steel, which increases the contact resistance of the surface of the first electrode pin 8. Confirmation was made through analysis of the surfaces of the electrode pins 8 and 9 according to the present embodiment by X-ray photoelectron spectroscopy (XPS) that there was an increase in ferric oxide $Fe_2O_2$ component on the surface of the first electrode pin 8 (positive electrode side) no more than 8 nm, and an increase in Fe component on the surface of the second electrode pin 9 (negative electrode side) no more than 8 nm. A natural oxide layer (passivation film) is normally 1 to 3 nm, and accordingly an oxide layer of at least 4 nm is covering the first electrode pin 8, or the density of ferric oxide $FeO_2$ in the surface layer of 1 to 3 nm is high, and the state is one in which a great oxide film is formed.

In the present embodiment, the above-described erroneous detection is resolved by applying oxidization aging signals described below across the electrode pins 8 and 9. That is to say, oxidization is intentionally promoted so that the amount of the oxide layer formed on at least the portion of the first electrode pin 8 exposed inside the liquid chamber is greater than the amount of the oxide layer formed on the portion of the second electrode pin 9 exposed inside the liquid chamber.

Figure 6A:
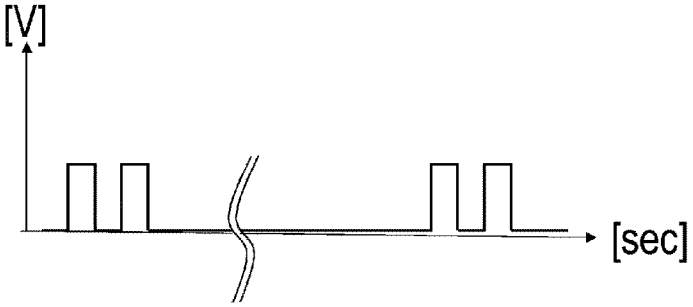
FIGS. 6A to 6E are diagrams of examples of ink-amount-detection input signals and examples of oxidization-aging input signals according to the present embodiment.

FIG. 6A is an example of ink-amount-detection input signals according to the present embodiment. FIGS. 6B to 6E illustrate examples of oxidization-aging input signals.

Normally, in a case where there is no need to constantly monitor the ink amount, detection thereof is often performed at a timing of change in the ink amount such as when starting printing, after ending printing, and so forth. Accordingly, after a detection pulse is input at least one time, two times in the present embodiment, at a timing to perform detection, no current flows across the electrode pins 8 and 9 until the timing of applying voltage, as illustrated in FIG. 6A.

In the present embodiment, the pulse input time is 15 msec and the inter-pulse interval time is 20 msec in FIG. 6A, but this is not limiting, depending on detection precision, noise, detectable time, and so forth. For example, in a full-line head configuration of a sheet-width size for sheet-fed printing ink depletion partway through printing can be reduced by setting the interval to the next detection pulse so as to be detection before and after printing one print. In a state of printing 50 prints per minute, detection is performed at approximately 833 msec intervals, and when there is no print job, no detection is performed until the next print job arrives. In a case of a serial operation type head that is operated in the width direction of the sheet, detection can be performed during the return time after ending printing to the edge portion in the sheet width. In a case of an average of 840 mm/sec for the head operation speed, and an A4 sheet width size of 210 mm, detection will be performed at approximately 250 msec intervals. No detection is performed when there is no print job, in serial operation type heads as well.

In a case of normal use as in the example above, using for prolonged periods gradually builds up the oxide layer 10, and eventually the characteristics change to those in the "used" graph in FIG. 4B. In order to avoid the above, the change in characteristics (oxidization) is forcibly advanced at the time of starting use of the image recording apparatus in the present embodiment, thereby reducing change in characteristics during use (hereinafter referred to as "oxidization aging"). Detection signals are consecutively input as in the signal input example in FIG. 6B. That is to say, the number of times of input of voltage pulses applied in one oxidization aging operation is greater than the number of times of input of voltage pulses applied in one detection operation. Preferably, the number of times is at least ten times greater. Thus, the rapidity of oxidization can be accelerated as compared to normal use. In the present embodiment, 3.3 V voltage for circuit driving is used for the detection voltage. In a case in which other voltages are being used for other operations, such as operations of the liquid ejection head, the voltage may be another voltage, such as 5 V, 24 V, or the like.

Figure 6B:
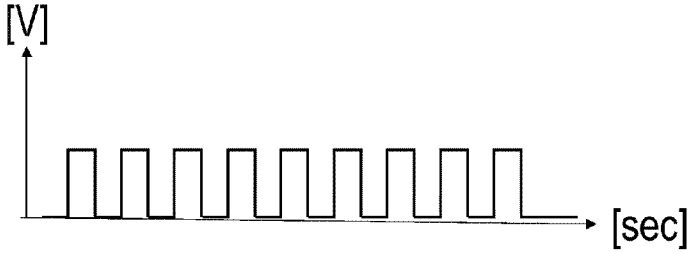

The existing detection system can be used for the present embodiment, without having to prepare special circuits or the like. In FIG. 6B, voltage is 3.3 V, pulse input time is 15 msec, and inter-pulse interval time is 20 msec, in the present embodiment, and variance in voltage and time around 10%, plus or minus, can be deemed to be approximately equivalent pulses.

Figure 6C:
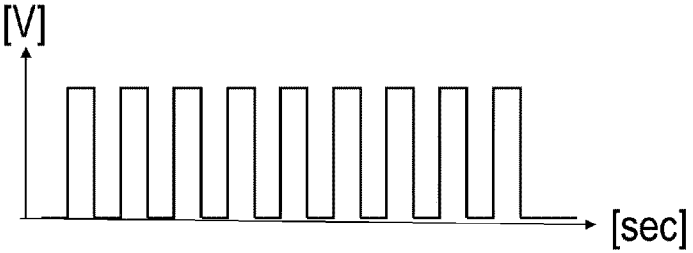

In the input signal example illustrated in FIG. 6C, pulses the same as detection signals are input in the same way, but the oxidization aging operations can be completed quicker by setting the absolute value of the pulse voltage to be greater than that of detection signals, i.e., by setting the potential higher (higher than 10%). For example, in a case of using high voltage of 24 V for a heater as in a thermal head, 3.3 V can be used for detection pulses and 24 V can be used for oxidization aging pulses.

Figure 6D:
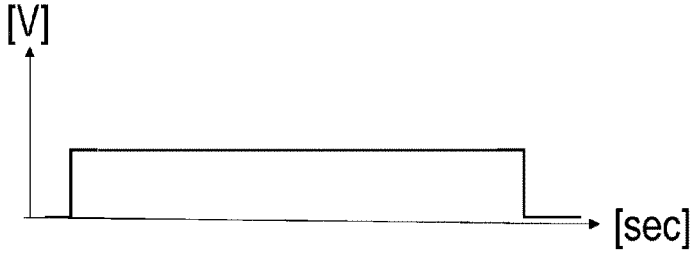
Figure 6E:
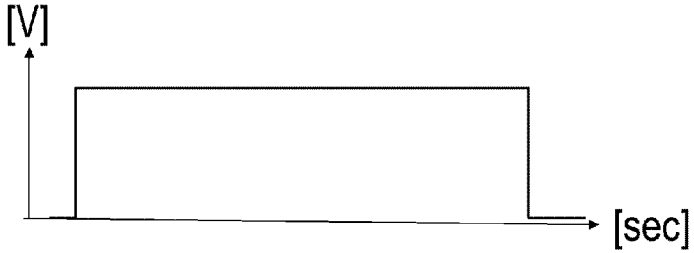

By continuous application of a constant voltage, instead of pulses, as in the input signal examples illustrated in FIGS. 6D and 6E, oxidization aging can be completed quicker than by pulse input. That is to say, the pulse duration of voltage pulses applied in the oxidization aging operations is made to be longer than the pulse duration of voltage pulses applied in the detection operations, preferably at least 10 times as long. In this case, oxidization aging can be completed quicker by setting the potential higher (higher than 10%). In a case where the arrangement has circuit driving constant voltage of 3.3 V and driving high voltage of 24 V in the same way as in the above example, constant voltage is applied.

In a state in which the ink pooling chamber 3 is filled with ink, and the ink liquid level height h=A, oxidization aging signal input according to any one of the above FIGS. 6B to 6E is used to perform oxidization aging.

Figure 7:
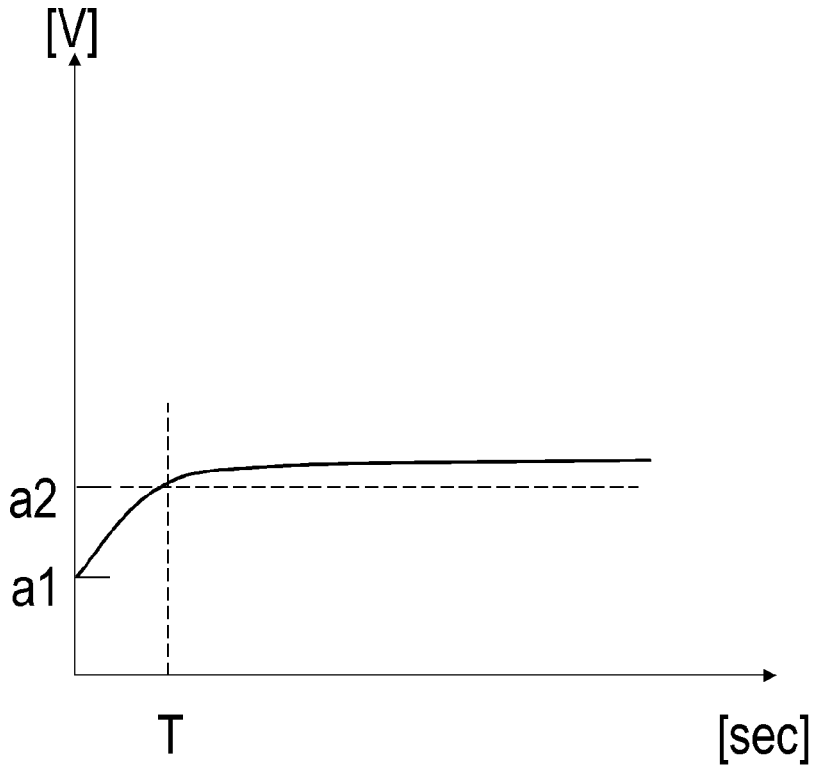
FIG. 7 is a graph of change in output of ink-amount-detection input signals as to voltage application time.

FIG. 7 is a graph showing change in output of the ink-amount-detection input signals in FIG. 6A as to voltage application time, as one example. The change of output is great in the voltage application time range of initial usage, and thereafter gradually converges over voltage application time. The time at which the detection output value as to ink liquid level height h=A changes from the initial output voltage a1 [V] to a2 [V] by oxidization aging for a certain unit time T [sec] is the time of completion of oxidization aging.

Figure 8:
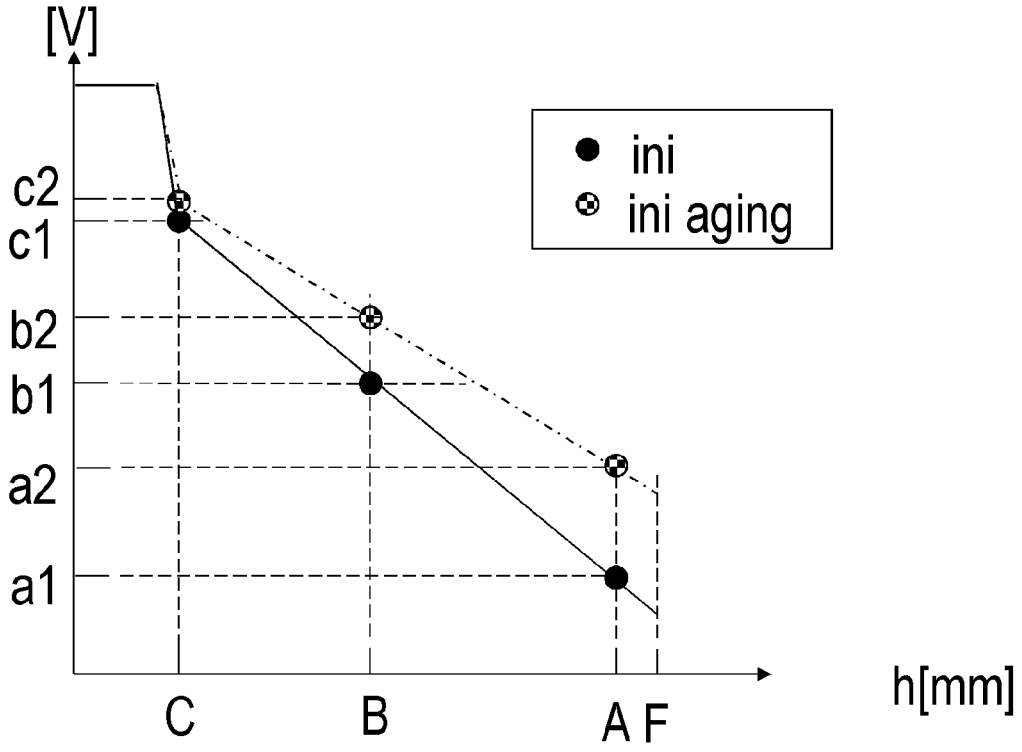
FIG. 8 is a graph showing change in output voltage according to oxidization aging.

It can be seen in FIG. 8 that the graph characteristics are changed from those in the "ini" graph to those in the "ini aging" graph as a result of the above oxidization aging. In the present embodiment, the oxidization aging time T is set to 600 sec for black ink using carboxylic type CB. Setting the oxidization aging time T longer further reduces the output change amount, and accordingly detection can be performed with higher precision.

Figure 10:
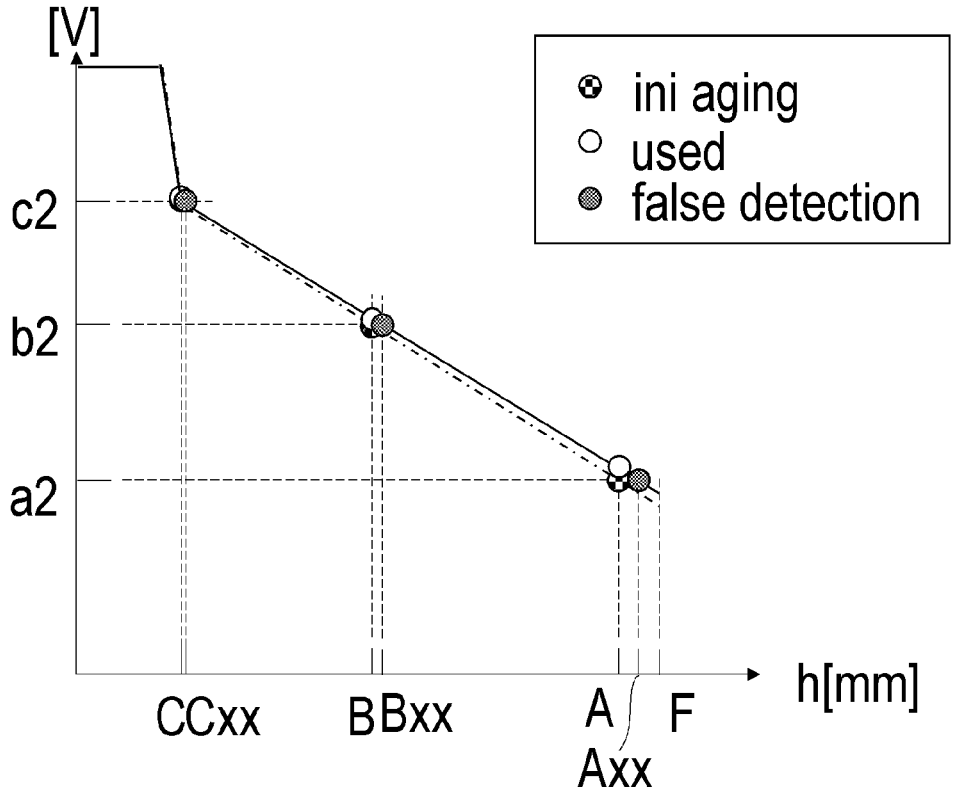
FIG. 10 is a graph showing change in output voltage according to oxidization aging.

The image recording apparatus according to the present embodiment has the threshold values a2, b2, and c2 in FIG. 10, and usage can be started from the state of the characteristics of the "ini aging" graph following oxidization aging. FIG. 10 also shows a "used" graph following usage for prolonged periods, and it can be seen that the difference as to the "ini aging" graph is small. Erroneous detection due to change in characteristics is also small.

Figure 9B:
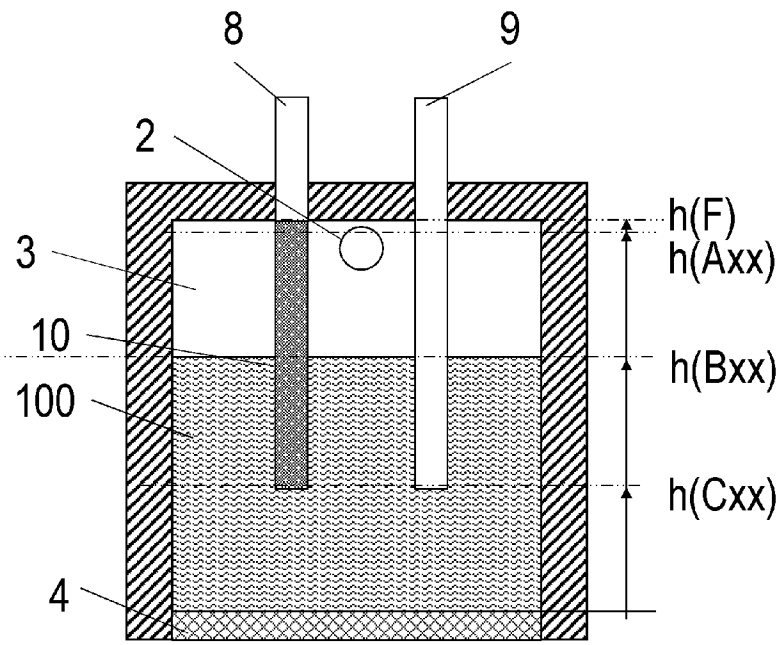
FIGS. 9A and 9B are schematic diagrams for describing effects of oxidization aging.
Figure 9A:
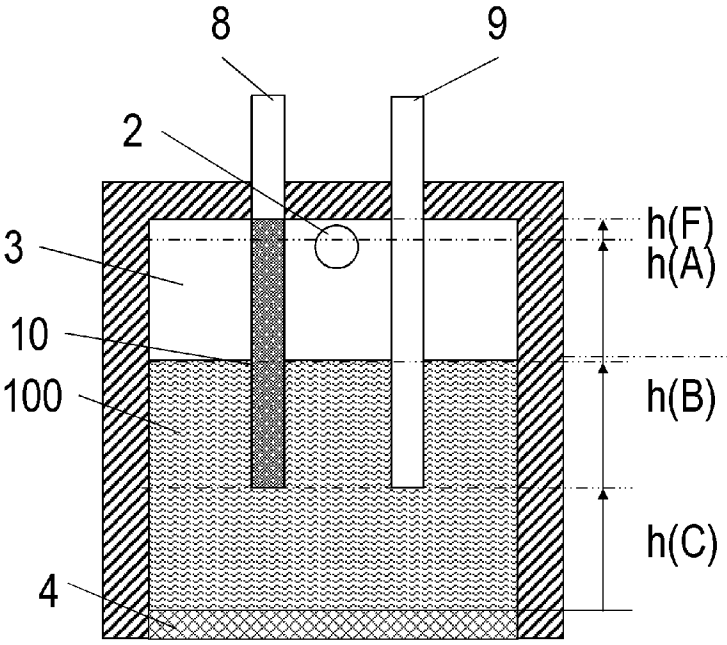

FIGS. 9A and 9B are cross-sectional views taken along B-B, FIG. 9A illustrating "ini aging" characteristics and FIG. 9B illustrating "used" characteristics. It can be seen from FIGS. 9A and 9B that the ink liquid levels heights are approximately equal between A and Axx, B and Bxx, and C and Cxx, at the respective threshold value voltages a2, b2, and c2, and accordingly the remaining amount of ink can be detected with higher precision than conventional systems.

The above-described oxidization aging operation sequence is performed before starting usage of the image recording apparatus, i.e., before performing the detection operation sequence for the remaining amount of ink. The oxidization aging operations can be performed a plurality of times. For example, the oxidization aging operations may be executed each time a plurality of detection operation sequences are executed, prior to the execution thereof. Also, as a modification of the present embodiment, there is a method in which the oxidization aging is performed in stages at timings when not being used by the user, and not only before starting usage. In this case, aging times are set for each of the oxidization aging timings, having respectively corresponding detection threshold value voltages. This arrangement enables the initial setup time to be reduced, since a lump amount of time for oxidization aging does not need to be set aside for the initial setup.

By performing the above-described oxidization aging operations, a state where the surface of the first electrode pin 8 (positive pole side) within the ink pooling chamber 3 is oxidized by a natural oxide layer (passivation film) can be configured, and the remaining amount of ink can be detected with high precision.

In the present embodiment, an example in which the ink pooling chamber 3 is disposed within the liquid ejection cartridge serving as a sub-tank has been shown. In a case of disposing the ink pooling chamber 3 inside the liquid ejection head (liquid ejection cartridge), there is demand for the ink pooling chamber 3 to be contained in a small capacity, since larger sizes lead to reduced printing speed and increased size of the apparatus. Also, in a case of supplying ink by a tube, air passes through the tube due to prolonged periods of unuse and so forth, and accordingly air irregularly flows into the ink pooling chamber 3, which may affect ejecting. Also, in the case of ink cartridges, the remaining amount of ink needs to be detected with high precision in order to prompt appropriate cartridge replacement. According to the present embodiment, oxidization is caused on the surface of the first electrode pin (anode side) in advance in an initializing step, whereby advance in oxidization during usage in a detecting step can be reduced. That is to say, the breadth of change in electrical resistance at the surface of the electrode pins can be suppressed, and the value of the electric current flowing across the electrode pins in a state where the amount of ink is a certain amount can be maintained constant. Accordingly, an ink-remaining-amount detecting system that can detect the remaining amount of ink, set in stages, with high precision, can be provided.

Also, according to the present embodiment, ink can be detected with high precision in the same way even in a configuration in which an ink pooling chamber is disposed in the image recording apparatus. That is to say, while the present embodiment is an application to detection of the remaining amount of ink within the liquid ejection head 1, application can be made to detection of whether ink is present or not within the ink tank 103 and in ink supply paths as well. In a case in which the ink pooling chamber is disposed in an image recording apparatus, such as in a case of a large-size apparatus, for example, loss in productivity due to ink depletion can be reduced by accurate detection of the remaining amount, in a case where continuous printing is desired without losing productivity.

A configuration may be made in which, opposite to the present embodiment, remaining amount detection is performed with the second electrode pin 9 as the anode side and the first electrode pin 8 as the cathode side.

Although the present embodiment is configured with the electrode pins inserted vertically downwards into the liquid chamber from above, the direction of insertion is not limited. Also, the number of electrode pins is not limited to two. For example, detection can be performed by disposing a plurality of anode pins as to one cathode pin, and a configuration may be made where at least three electrode pins are used with differing depths of entering the liquid, or a plurality of detection positions being set in the liquid chamber to raise detection precision.

Second Embodiment

In a second embodiment, the oxidization aging according to the above first embodiment is performed in the process of assembling the liquid ejection cartridge unit. That is to say, oxidization aging is in a state of having been completed to a certain extent at the time of shipping the image recording apparatus. This is a production process, and accordingly the user can start printing immediately, without having to take time for oxidization aging processing upon startup of the image recording apparatus. That is to say, at the point of executing the oxidization aging operation sequence the first time after starting usage of the image recording apparatus, aging has already been completed to a certain extent, and accordingly the time required for this sequence can be shortened.

In the assembly process, the input signals in FIGS. 6B to 6E are applied in a state filled with ink and with the first electrode pin 8 as the positive pole side and the second electrode pin 9 as the negative pole side, in the same way as with the oxidization aging according to the first embodiment. Alternatively, a pin serving as the first electrode pin 8 may be imparted an oxide layer equivalent to that of the above oxidization aging, by treating with heat or the like in advance, and thereafter assembling the pin into the ink pooling chamber 3, whereby the same advantages can be obtained. For example, it has been confirmed that thermal treatment of SUS304 stainless steel at 400° C. in the ambient atmosphere for around three hours increases Fe oxides on the surface.

In a case of performing filling with ink and oxidization aging in the production process, applying the voltage, pulses, and so forth in FIGS. 6A to 6E can be performed and output values can be measured, thereby enabling manufacturing while managing a predetermined oxide layer state by output values. This is preferable from the point of improved detection precision, since a desired oxide layer state can be maintained and managed in a sure manner. Electrochemical polishing is similar processing.

In a case of thermal treatment, being able to selectively process the surface of a pin within the ink pooling chamber is desirable, but there is a possibility that the oxide film will be increased on the entire pin. Accordingly, the contact resistance increases as to the wiring for measurement of the voltage output for detection. There are cases in which this can be dealt with by increasing the surface area of the contact resistance portion, or by plating the material of the contact resistance portion with low-resistance gold plating. However, thermal treatment is advantageous from the point of process simplification, since ink, electric power, and performing ink processing following oxidization aging are unnecessary during the production process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-104275, filed on Jun. 17, 2020, which is hereby incorporated by reference herein in its entirety.

What is claimed is:

1. An image recording apparatus, comprising:

a liquid chamber that stores liquid to be used in recording an image;

a first electrode pin and a second electrode pin inserted into the liquid chamber;

applying unit for applying voltage across the first electrode pin and the second electrode pin, with the first electrode pin serving as an anode side and the second electrode pin serving as a cathode side; and detecting unit for detecting electric current flowing across the first electrode pin and the second electrode pin, wherein the image recording apparatus is configured to perform a detection operation of detecting a remaining amount of liquid in the liquid chamber by the detecting unit detecting the electric current when the applying unit applies a voltage across the first electrode pin and the second electrode pin, prior to executing the detection operation, an oxidization aging operation is performed, in which the applying unit applies voltage across the first electrode pin and the second electrode pin, and an amount of an oxide layer formed on at least a portion of the first electrode pin exposed inside the liquid chamber is greater than an amount of an oxide layer formed on a portion of the second electrode pin exposed inside the liquid chamber.

2. The image recording apparatus according to claim 1, wherein the detection operation is performed a plurality of times, wherein the oxidization aging operation is performed a plurality of times corresponding to each of the plurality of detection operations, and wherein a detection threshold value of the electric current in the detection operation is set for each of the plurality of detection operations.

3. The image recording apparatus according to claim 1, wherein a count of inputs of a voltage pulse applied in one time of performing the oxidization aging operation is at least ten times a count of inputs of a voltage pulse applied in one time of performing the detection operation.

4. The image recording apparatus according to claim 1, wherein a pulse duration of a voltage pulse applied in the oxidization aging operation is at least ten times a pulse duration of a voltage pulse applied in the detection operation.

5. The image recording apparatus according to claim 1, wherein an absolute value of voltage applied in the oxidization aging operation is greater than an absolute value of voltage applied in the detection operation.

6. The image recording apparatus according to claim 1, wherein the electrode pins are made of SUS304 stainless steel or SUS316 stainless steel.

7. The image recording apparatus according to claim 1, further comprising:

a liquid ejection head; and a liquid supply tube that supplies liquid from the liquid chamber to the liquid ejection head.

8. The image recording apparatus according to claim 1, further comprising:

a liquid tank;

a liquid ejection head including a recording element substrate and a sub-tank; and a liquid supply tube that supplies liquid from the liquid tank to the sub-tank, wherein the liquid chamber is a liquid chamber of the sub-tank and supplies liquid supplied from the liquid supply tube to the recording element substrate.

9. The image recording apparatus according to claim 1, further comprising:

a liquid tank; and a liquid ejection head including a recording element substrate and a sub-tank connected to the liquid tank, wherein the liquid chamber is a liquid chamber of the sub-tank and temporarily holds liquid supplied from the liquid tank, and supplies the liquid to the recording element substrate.

10. The image recording apparatus according to claim 1, wherein the liquid is ink that uses self-dispersing carbon black.

11. The image recording apparatus according to claim 1, wherein, at a point in time of shipping, an amount of an oxide layer formed on at least a portion of the first electrode pin exposed inside the liquid chamber is greater than an amount of an oxide layer formed on a portion of the second electrode pin exposed inside the liquid chamber.

12. The image recording apparatus according to claim 1, wherein, at a point in time prior to the oxidization aging operation being performed a first time, an amount of an oxide layer formed on at least a portion of the first electrode pin exposed inside the liquid chamber is greater than an amount of an oxide layer formed on a portion of the second electrode pin exposed inside the liquid chamber.

13. The image recording apparatus according to claim 1, wherein a detection threshold value of the electric current in the detection operation is set to correspond to an oxide layer state obtained in the oxidation aging operation.

14. The image recording apparatus according to claim 1, wherein the amount of an oxide layer is density or thickness.

15. The image recording apparatus according to claim 1, wherein the detection operation detects a level of the remaining amount of liquid in the liquid chamber.

16. The image recording apparatus according to claim 1, wherein, the voltage applied across the first electrode pin and the second electrode pin in the oxidization aging operation is greater in level or in duration than the voltage applied across the first electrode pin and the second electrode pin in the detection operation.

* * * * *